US005609283A

United States Patent [19]

Harrison, Jr.

[11] Patent Number: 5,609,283

[45] Date of Patent: Mar. 11, 1997

[54] UTILITY BELT FOR PAINTERS AND METHODS

[75] Inventor: William E. Harrison, Jr., Norman, Okla.

[73] Assignee: Dunlap & Codding, P.C., Oklahoma City, Okla.

[21] Appl. No.: 472,094

[22] Filed: Jun. 7, 1995

[51] Int. Cl.[6] ..... A45F 5/00

[52] U.S. Cl. ..... 224/678; 224/677; 224/904; 224/247; D3/228

[58] Field of Search ..... 224/148, 162, 224/240, 142, 245, 252, 904, 148.1, 148.4, 660, 676, 677, 678, 232, 234, 901, 247, 248; D3/228

[56] References Cited

U.S. PATENT DOCUMENTS

| | | | |
|---|---|---|---|
| 318,215 | 5/1885 | Stahl | 224/678 |
| 1,818,514 | 11/1931 | Whitaker | 242/588.1 |
| 2,543,313 | 2/1951 | Dietzgen | 224/240 |
| 3,343,735 | 9/1967 | Breeding et al. | 224/678 |
| 4,113,156 | 9/1978 | Brito | 224/904 |
| 4,269,338 | 5/1981 | Sichel | 224/242 |
| 4,408,706 | 10/1983 | Hurley | 224/904 |
| 4,705,086 | 11/1987 | O'Neill | 224/240 |
| 4,830,247 | 5/1989 | Banks | 224/904 |
| 4,880,152 | 11/1989 | Trankle | 224/162 |
| 5,052,603 | 10/1991 | Spina | 224/904 |
| 5,072,868 | 12/1991 | Dickie et al. | 224/904 |
| 5,201,445 | 4/1993 | Axelman | 224/904 |
| 5,232,137 | 8/1993 | Devine | 224/148 |
| 5,240,156 | 8/1993 | Sicotte et al. | 224/148 |
| 5,302,302 | 4/1994 | Shelley et al. | 224/245 |
| 5,341,975 | 8/1994 | Marinescu | 224/904 |
| 5,392,975 | 2/1995 | Blankenship, Jr. | 224/242 |
| 5,452,830 | 9/1995 | Hopkins et al. | 224/252 |
| 5,500,786 | 9/1991 | DeMott | 224/245 |

*Primary Examiner*—Henry J. Recla
*Assistant Examiner*—Gregory M. Vidovich
*Attorney, Agent, or Firm*—Dunlap & Codding, P.C.

[57] ABSTRACT

A utility belt for painters having a holders for painting devices and tools, and releasable connectors for connecting the holders to the utility belt. Methods of using a utility belt for painters.

10 Claims, 5 Drawing Sheets

UTILITY BELT FOR PAINTERS AND METHODS

BACKGROUND OF THE INVENTION

1. Field of the Invention

This invention generally relates to utility belts used to carry various apparatus and supplies, and, more particularly, to utility belts utilized by painters for carrying or holding apparatus, supplies, and the like, and the methods of using same.

2. Background Information

In the painting art, an operator who is spray painting, roller painting or brush painting must stop working to retrieve various needed tools and apparatus, such as a spray gun, a caulking gun, masking tape, spray tips used in a spray gun, spray gun filters, and the like. Often, these various tools and apparatus are in different locations. Such a work stoppage, to locate these items, is time consuming and increases labor costs.

Further, when an operator is on a ladder or scaffolding, said operator must climb down to retrieve such aforementioned articles. Further, while climbing upward or downward, said operator is often carrying one or more tools or apparatus in one or both hands, thereby increasing the risk of danger, such as injury from a fall.

A utility belt which holds various tools, apparatus, and items, which is worn by an operator while painting, would be desirable. Yet, such a utility belt might cause danger, because such tools and apparatus hanging from the belt might catch against the ladder or scaffolding, causing the operator to lose balance, again resulting in injury from a fall.

Therefore, there is a need felt in the art for a utility belt for painters which permits usual tools and apparatus used in regular painting jobs, such as caulking guns, spray guns, spray hose, spray tips and filters for the spray gun, masking tape, and the like, to be carried on the belt. Further, there is a need felt in the art for a utility belt which permits each item attached to the belt to pull away, off of the belt, so that falls do not result from items on an operator's belt becoming snagged or otherwise connected to articles such that the snagging or connection causes the operator to lose his balance.

Such a utility belt promotes safety by preventing falls resulting in an operator (painter) trying to go up and down scaffolding or ladders with one or more tools in his hand; the operator can now dispose all tools and other items on the utility belt. Further, such a utility belt promotes safety by preventing falls resulting from the belt which becomes snagged or otherwise accidently connected to another article; each item on the belt will now pull away from the belt.

It is an objective of the present invention to provide a utility belt for painters which contains holders for commonly used items, thereby keeping the operator's hands free while moving up and/or down ladders or scaffolding. It is a further object of the present invention to provide a utility belt in which each item thereon, including the holder for the item, will pull away if accidently snagged or caught upon an article. In this way, the operator is not accidently pulled off balance by such unwanted snagging of items on the belt, holders, or the belt itself. It is a goal of the present invention to enhance the safety of the operator during a painting procedure while reducing wasted time and labor costs.

BRIEF DESCRIPTION OF THE DRAWINGS

Other objects, features and advantages of the present invention will become more fully apparent from the following detailed descriptions of the preferred embodiments, the appended claims and the accompanying drawings in which:

FIG. 6 is a side elevational view of the caulking gun holder having a caulking gun therein, but showing a phantom view of the caulking gun being released from the caulking gun holder;

DESCRIPTION OF THE PREFERRED EMBODIMENTS

Figure 1:
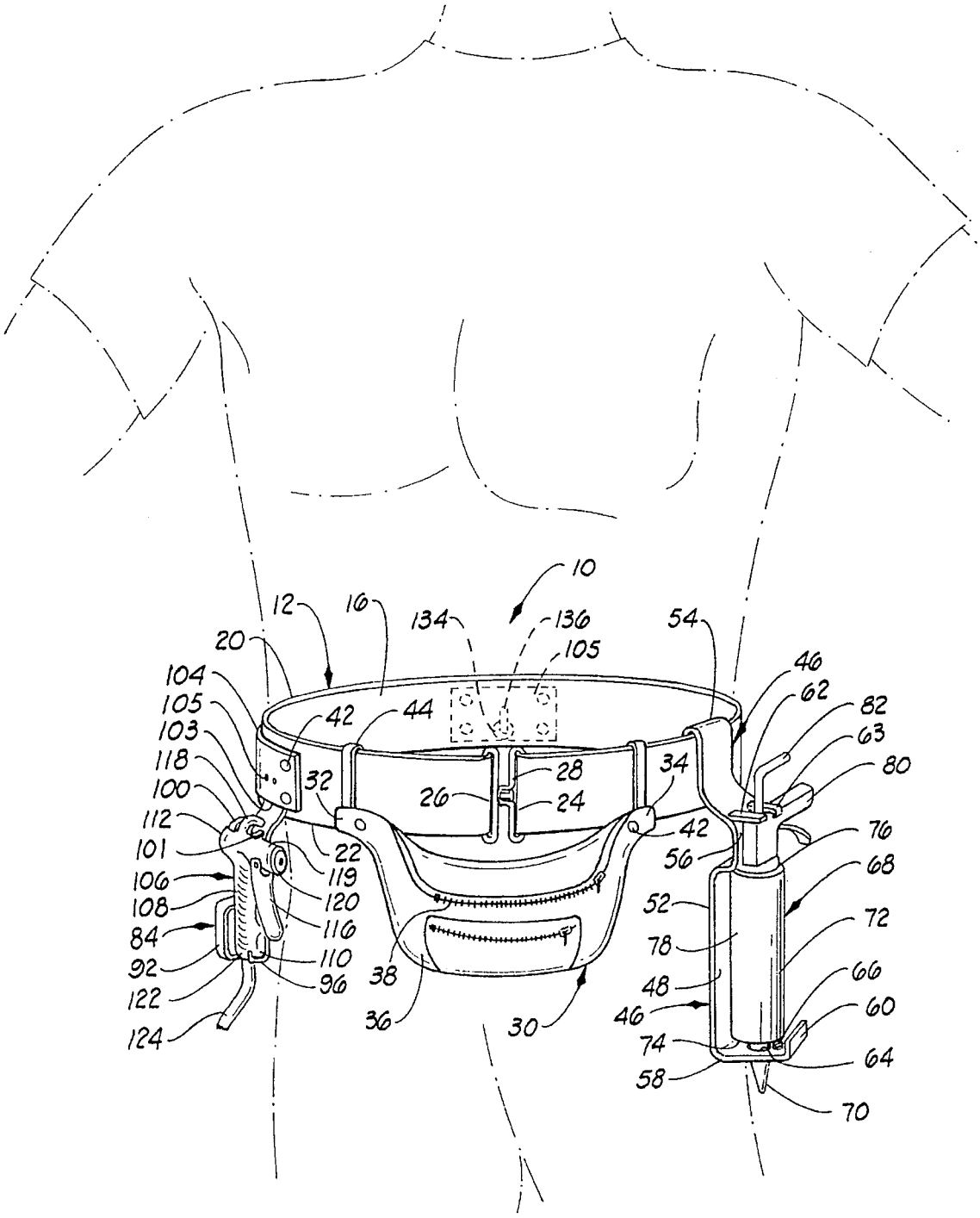
FIG. 1 is a perspective view of the utility belt for painters of the present invention, but showing the a phantom figure of an operator having said utility belt connected thereabout, showing a belt, a caulking gun in a caulking gun holder, a spray gun in a spray gun holder, a pouch for carrying spray tips, spray filters, and the like, a masking tape machine, and a snap for connecting a portion of the pump hose extending from the paint pump assembly to the spray gun, all constructed in accordance with the present invention.

The Embodiments and Methods of FIGS. 1–7

Referring now to FIGS. 1–7, designated generally by the reference numeral 10 is a utility belt for painters which is constructed in accordance with the present invention. The utility belt 10 comprises a belt portion 12 having an upper surface 14, a lower surface 16 and an outer periphery 18. The outer periphery further comprises a first side 20, a second side 22, a third side 24 and a fourth side 26. The belt portion 12, on both the third side 24 and the fourth side 26, has a closure element 28. "Closure element" as used herein means any easily connectable and easily releasable closure element, but preferably means a closure element, which will opening and release when manipulated by an operator (the term "operator" and "painter" is used exchangeably herein). Preferably, the closure element will not open and release involutarily, without being manipulated by an operator.

The belt portion 12 is made from any material which has sufficient strength to connect various apparatus, such as painting apparatus and supplies, thereto. Such a material includes, but not by way of limitation, nylon, plastic, cotton, fiber, cloth (synthetic or natural, woven or non-woven), vinyl, leather, metal, rubber, and combinations thereof.

A pouch 30 is connected to the belt portion 12. The pouch has a first end 32, a second end 34, and outer surface 36, an opening element 38 (opening element, as used herein, includes, but not by way of limitation, an opening created by a zipper, snaps, hooks and eyes, hook and loop material such as VELCRO, or any other widely known component which permits an easy opening and easy closure to an item), a retaining space (not shown)a plurality of connecting elements 42 (only one of the plurality of connecting elements being designated 42), and a plurality of hook elements 44 (only one of the plurality of hook elements being designated 44). At least one of the plurality of connecting elements 42 is connected to at least one of the plurality of hook elements 44 to connect the pouch 30 to the belt portion 12.

"Connecting element" as used herein means any readily connectable yet readily, and involuntarily, releasable element, such as, but not by way of limitation, hook and loop material such as VELCO, snaps, and any other similar component known in the art which operates in the manner described and shown herein for connecting elements. "Hook element" as used herein means any component formed with a generally U-shaped flange or J-shaped flange which is forms a shallow side of the "U" shape on one side, which may be hooked over a component, such as the belt portion 12 shown herein. Having a "U" shape permits the hook element to be place on a surface of the belt portion 12 and to hook over, for example, but not by way of limitation, the first side 20 of the belt portion 12, thereby having a portion thereof contacting the opposing surface of the belt portion 12 as well. Having a shallow side of the "U", however, permits the hook element to be pulled away from the belt portion 12 should the hook element, or any component being held by a hook element, be snagged or involuntarily tugged or pulled. It will be appreciated that the pouch 30 is often connected to the belt portion 12 via a pouch connecting element 42 alone.

The pouch 30 may be made from any material which has sufficient strength to retain certain painting tools, such as, for example but not by way of limitation, spray tips and spray gun filters. Such a material includes, but is not limited to, nylon, plastic, cotton, fiber, cloth (synthetic or natural, woven or non-woven), vinyl, leather, metal, rubber, and combinations thereof.

The belt portion 12 of the utility belt 10 further comprises a caulking gun holder, as best shown in FIGS. 2–4 and 6. The caulking gun holder 46 comprises a first surface 48, a second surface 50, and an outer periphery 52. The caulking gun holder 46 further comprises a caulking gun hook element 54, which permits the caulking gun to be connected to the belt portion 12, as described previously herein. It will be appreciated, however, that a connecting element, as described previously, is often used to connect the caulking gun holder 46 to the belt portion 12 of the utility belt 10. Said connecting element would contact a portion of the caulking gun holder 46, such as the hook element 54, thereby permitting a separate connection between the hook element 54 and the belt portion 12, said connection being easily connectable and easily releasable, said connection becoming disconnected if the caulking gun holder is snagged or pulled with force. It will further be understood that a connecting element, as described herein, may take the place of the hook element 54, and may be utilized to connect the caulking gun holder 46 to the belt portion 12.

The caulking gun holder 46 has a first flange portion 56 and a second flange portion 58 having a flange lip 60. A straight flange portion 62 extends outward at a generally perpendicular angle with respect to the first flange portion 56. Spaced a short distance from the straight flange portion 62 is a curved flange portion 63. The curved flange portion 63 also extends outward at a generally perpendicular angel with respect to the first flange portion 56. The second flange portion 58 has an aperture 64 therein sized to receive the nozzle end of a caulking gun. A spring 66 is connected to the second flange portion 58, and is disposed between the aperture 64 and the flange lip 60.

The caulking gun holder 46 may be made from any material which has sufficient strength to retain the caulking gun 68 within the caulking gun holder 46. Such a material includes, but is not limited to, nylon, plastic, vinyl, metal, rubber, and combinations thereof.

As shown in FIGS. 1 and 6, a caulking gun 68 is disposed in the caulking gun holder 46. The caulking gun 68 comprises a nozzle end 70 connected to a caulking container 72 for containing a caulking substance (not shown). The caulking container 72 has a first end 74, a second end 76 and an outer periphery 78. A handle 80 is connected to the second end of the caulking gun 68, and the handle 80 has a flange extension 82.

The caulking gun 68 is held in the caulking gun holder 46 such that the nozzle end 70 extends through the aperture 64 therein, and a portion of the first end 74 of the caulking container 72 depresses the spring 66. The first flange portion 56 extends above and over the second end 76 of the caulking gun 68, the second end 76 of the caulking gun 68 being directly adjacent thereto and firmly pressing against the first flange portion 56. The handle 80 lies adjacent the first flange portion 56, and the straight flange portion 62 and the curved flange portion 63 are directly adjacent, the handle 80 being pressed against both the straight flange portion 62 and the curved flange portion 63. The flange extension 82 of the handle 80 extends through the opening between the straight flange portion 62 and the curved flange portion 63 of the caulking gun holder 46. It will be appreciated that the spring 66 pushes against the first end 74 of the caulking gun 68, thereby causing the above described contacts and pressure between the caulking gun 68 and the caulking gun holder 46, said contacts and pressure being sufficiently firm that the caulking gun is held firmly by the caulking gun holder 46.

As shown in FIG. 6, to release the caulking gun 68, an operator depresses the handle 80 and/or the flange extension 82 of the caulking gun 68, causing the spring 66 to become depressed as well. The second end 76 of the caulking gun is thereby moved a distance downward away from the contact with first flange portion 56 of the caulking gun holder 46. The caulking gun 68 is then moved, by the handle 80 and flange extension 82 outward, away from the contact between the handle 80 and the straight flange portion 62 and curved flange portion 63, the flange extension moving away from the opening between the straight flange portion 62 and the curved flange portion 63. To completely release the caulking gun 68 from the caulking gun holder 46, the caulking gun 68 is simply moved upward, away from the caulking gun holder 46, the nozzle end 70 being removed from the aperture 64. To replace the caulking gun 68 in the caulking gun holder 46, it will be understood that this procedure is simply reversed.

Referring now to FIGS. 1–3, 5 and 7, the belt portion 12 of the utility belt 10 further comprises a spray gun holder 84. The spray gun holder comprises a first surface 86, a second surface 88, and an outer periphery 90. The spray gun holder 84 has a "C" flange. Spaced nearby, with a hose opening 94 therebetween, is a lower handle flange 96. A spring 98 is disposed on the lower handle flange 96. The spray gun holder 84 also has an upper handle flange 100 and a central flange 101. A semi-circular cutout 102 is formed on a portion of the outer periphery 90 of the spray gun holder 84. The spray gun holder 84 further comprises an upper end 103 which attaches to a connecting portion 104. The connecting portion 104 comprises a connecting patch 105 having a plurality of connecting elements 42 attached thereto, the connecting elements 42 connecting to corresponding connecting elements 42 disposed on the upper surface 14 of the belt portion 12. The upper end 103 of the spray gun holder 84 is attached to the connecting patch 105 via bolts, adhesive, hook and loop material such as VELCRO, snaps, screws, or any means known in the art.

The connecting patch 105 may be utilized with any of the primary holder components described herein to connect the holders to the belt portion 12. Such a connecting patch 105 will permit the holder connected thereto, and the apparatus being held, to be pulled away, off of the belt portion 12, should the holder and/or apparatus become snagged. In this manner, the connecting patch 105 provides greater safety for an operator, and lessens the chance of injury. It will be understood that the connecting patch 105 may be made from any material, or combination of materials, described previously herein for making the belt portion 12.

The spray gun holder 84 may be made from any material which has sufficient strength to retain the spray gun 106 within the caulking gun holder 84. Such a material includes, but is not limited to, nylon, plastic, vinyl, metal, rubber, and combinations thereof.

Figure 7:
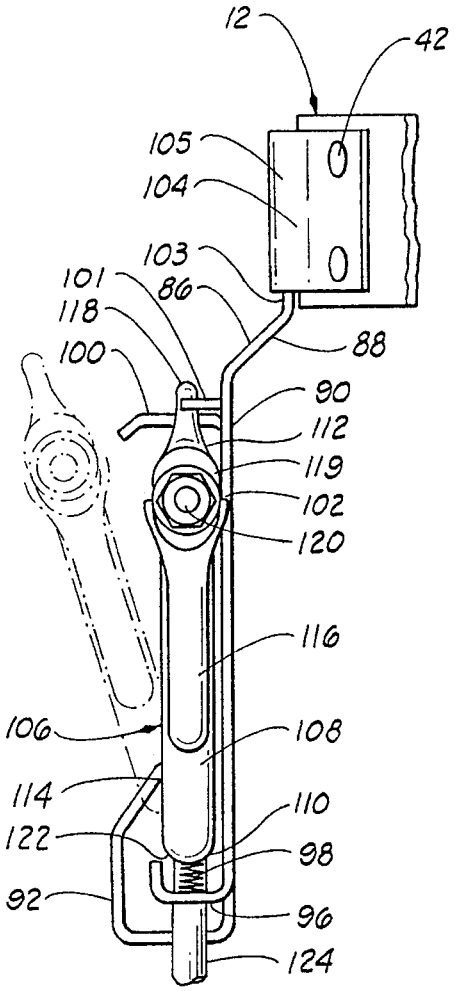
FIG. 7 is a side elevational view of the spray gun holder having a spray gun therein, but showing a phantom view of the spray gun being released from the spray gun holder.

As shown in FIGS. 1 and 7, a spray gun 106 is disposed in the spray gun holder 84. The spray gun 84 comprises a handle 108, having a lower end 110, an upper end 112, and an outer periphery 114. The handle further comprises a trigger 116. A flange portion 118 extends from the upper end 112 of the spray gun 106. The spray gun 106 further comprises a spray portion 119 and a spray outlet 120 for emitting a spray of a paint composition, and an inlet port 122 at the lower end 110 for receiving a paint composition. The spray gun 106 has a retaining space therein (not shown) for retaining a paint composition. A pump hose 124 (shown partially cutaway in FIG. 1) connects to the inlet port 122 of the spray gun 106.

The spray gun 106 is held in the spray gun holder 84 such that the lower end 110 of the handle 108 is adjacent and pressed against the "C" flange 92 of the spray gun holder 84, the pump hose 124 extending through the opening between the "C" flange 92 and the lower handle flange 96, the remainder of the handle 108 resting against the lower handle flange 96 and the spring 98 disposed thereon. The handle 108 is adjacent to and in contact with the first surface 86 of the spray gun holder 84, the upper end 112 of the handle 108 is adjacent to and firmly pressed against the upper handle flange 100, the central flange 101 of the spray gun handle 84 extending below, and pressed firmly against the flange portion 118 of the spray gun 106. The spray portion 119 presses against the first surface 86 of the spray gun holder 84, the semi-circular cutout 102 accommodating the form of the spray portion 119. It will be appreciated that the spring 98 pushes against the lower end 110 of the spray gun 106, thereby causing the above described contacts and pressure between the spray gun 106 and the spray gun holder 84, said contacts and pressure being sufficiently firm that the spray gun 106 is held firmly by the spray gun holder 84.

As shown in FIG. 7, to release the spray gun 106, an operator depresses the handle 80 of the spray gun 106 downward, causing the spring 98 to become depressed. The upper end 112 of the spray gun 106, including the flange portion 118 is thereby moved away from a pressing contact with the upper handle flange 100 and the central flange 101. The upper end 112 of the spray gun 106 is then rotated outward, away from the spray gun holder 84. The spray gun 106 is then completely released and removed from the spray gun holder 84 by lifting the spray gun 106 upward and outward, away from the spray gun holder 84, thereby releasing the pump hose 124 from the hose opening 94 of the spray gun holder 84. To replace the spray gun 106 in the spray gun holder 84, it will be understood that this procedure is simply reversed.

Figure 2:
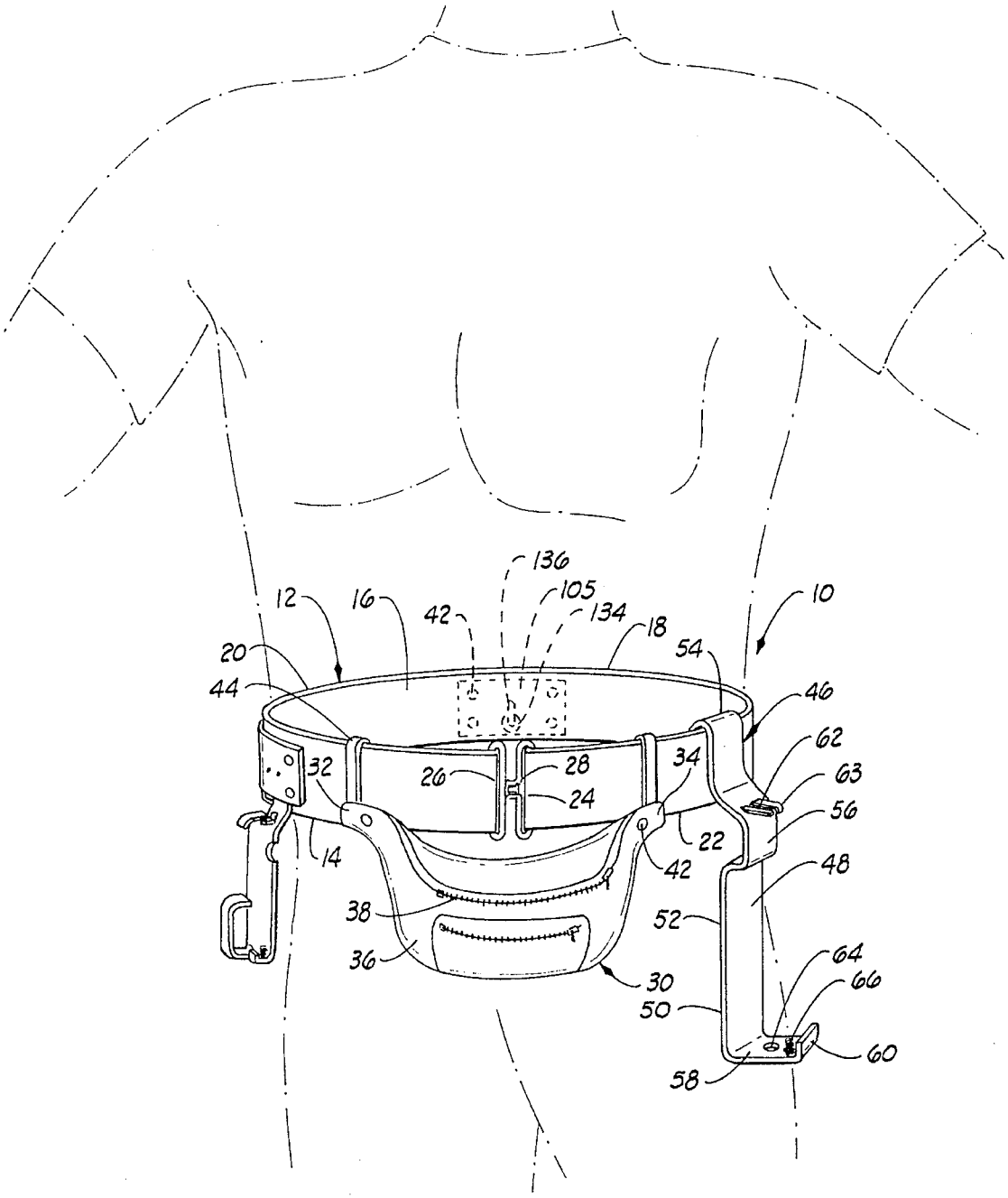
FIG. 2 is a perspective view of the utility belt of FIG. 1, but showing the caulking gun holder without a caulking gun therein and the spray gun holder without a spray gun therein.
Figure 3:
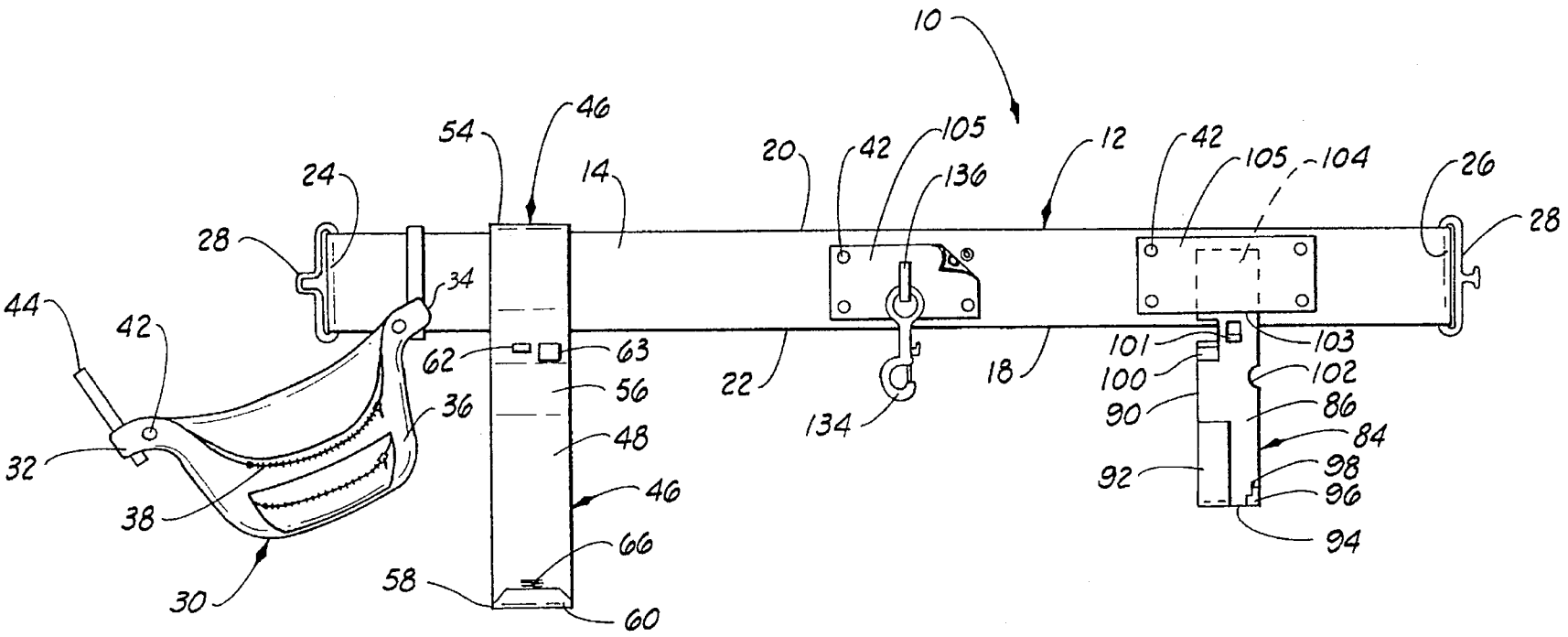
FIG. 3 is a top plan view of the utility belt of FIG. 1, showing the length of the utility belt.
Figure 4:
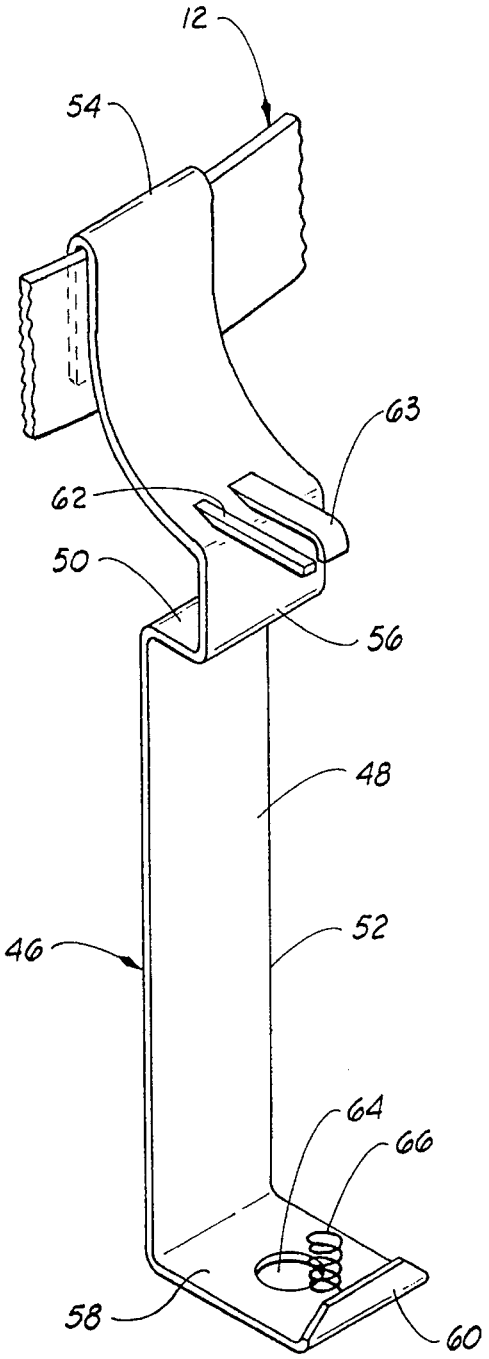
FIG. 4 is a perspective view of the caulking gun holder.
Figure 5:
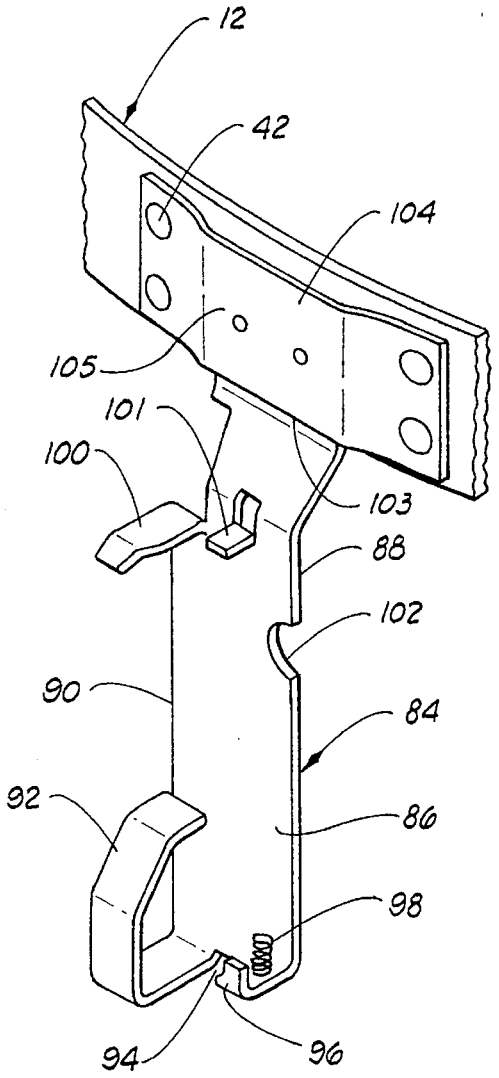
FIG. 5 is a perspective view of the spray gun holder.
Figure 5:
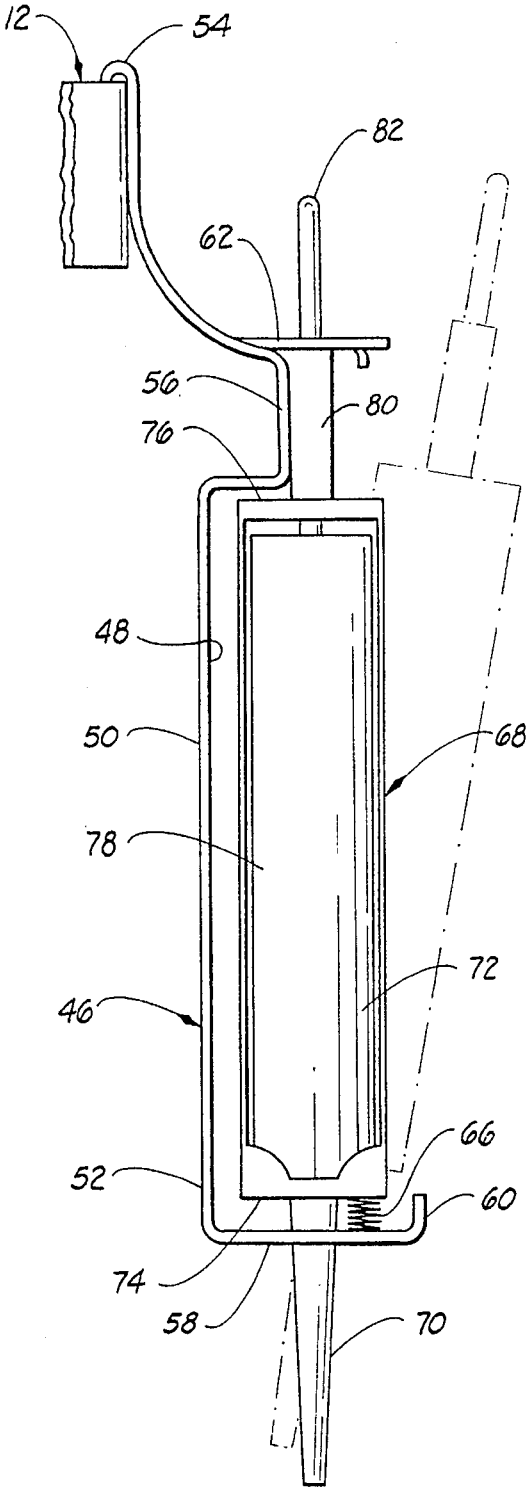

The belt portion 12 of the utility belt 10 further comprises a masking tape machine holder 126, as illustrated in FIGS. 1–3. The masking tape machine holder 126 comprises a roller 128 connected to a roller holder 130. The roller holder 130 spaces the roller 128 a short distance from the belt portion 12, thereby permitting a masking tape machine (not shown) to be disposed on the roller 128 and/or the roller holder 130, such that no pressure from the belt portion 12 or the roller holder 130 is applied to the masking tape machine. An operator may therefore easily remove the masking tape machine from the roller 128 for use (not shown). The roller holder 130 further comprises a modified U-shaped hook 132, which operates in the same manner as described previously for the hook element 44. The modified U-shaped hook 132 connects the roller holder 130 to the belt portion 12 in a manner which has been described previously herein.

The masking tape machine holder 126 may be made from any material which has sufficient strength to retain a masking tape machine. Such a material includes, but is not limited to, nylon, plastic, vinyl, metal, rubber, and combinations thereof.

It will be appreciated, however, that a connecting patch 105 is often used to connect both the roller holder 130 to the belt portion 12 and the caulking gun holder 46 to the belt portion. The connecting patch 105 may also be used to connect the pouch 30 to the belt portion 12.

The belt portion 12 further comprises a snap connector 134. The snap connector connects to a ring 136 connected to a connecting patch **105*a*, as shown in FIGS. 1–3. The snap connector 134 connects to any kind of compatible connector attached to the pump hose 124. Snap connectors 134** are known in the art, and are commercially available.

Such a "compatible connector" would include, but not by way of limitation, a ring connected to a portion of the pump hose 124, another snap connector connected to a portion of the pump hose 124, or any other connecting means known to those having ordinary skill in the art which permits a section of the pump hose 124 to be connected to the snap connector 134 described herein. Such a compatible connection may be formed by using tape, metal rings, or any other means or apparatus known in the art.

An operator often places such a compatible connection on the pump hose 124 about two to about six feet from the pump hose 124 connection to the inlet port 122 of the spray gun 106. The operator then connects the compatible connection to the snap connector 134, so that a tug or pull on the pump hose 124 will not inadvertently pull the spray gun 106 and/or the spray gun holder 84 from the operator's hands or belt portion 12 during use of the spray gun 106. It will be appreciated that the snap connector 134 shown, or any other type of connector that readily attaches and disconnects from an article, such as the compatible connector described herein, may also be utilized. It will also be understood that a significant pull from the pump hose 124 will release the connecting patch **105*a***, thereby preventing the operator from possibly falling from such a tug.

In a general method of use, the utility belt 10, as shown in FIG. 3, is connected about the waist of an operator (shown in as a phantom figure in FIG. 1 and 2), as illustrated in FIG. 2. The spray gun 106 and the caulking gun 68 are then disposed in the spray gun holder 84 and the caulking gun holder 46, respectively, as shown in FIG. 1, and as described in detail herein previously. The pouch 30 is opened via the opening element 38, and various supplies and tools, such as additional spray tips and spray filters for the spray gun 106, are placed in the pouch 30. The pouch 30 is connected to the belt via the connecting elements 42 and/or the hook elements 44 attached to the pouch 30. A masking tape machine (not shown) is disposed on the roller 128 of the roller holder 130 of the masking tape machine holder 126. The pump hose 124 is connected to the snap connector 134 (not shown) as described herein previously in detail. The operator removes the spray gun 106 from the spray gun holder 84 as needed, and replaces the spray gun 106 back into the spray gun holder 84 when the operator is not using the spray gun 106. Similarly, the operator removes the caulking gun 68 from the caulking gun holder 68 as needed, and replaces the caulking gun 68 back into the caulking gun holder 46 when the operator is not using the caulking gun 68. It will be appreciated that the utility belt is quickly and easily removed by the operator when a painting process if finished.

It will be understood that the holders and other devices which connect to the belt portion 12, as described herein, will not detach from the belt portion 12 with simply insignificant pulls or tugs. Rather, a significant pull or tug, such as one which would unbalance an operator, is required for the holder or device (including, at times, the connecting elements 42, the hook elements 44, and/or connecting patches 105) to release from the belt portion 12. It will be understood that all components described herein are deemed holders, including the pouch 30 and the snap connector 134, since the pouch 30 holds various painting supplies and tools and since the snap connector holds a portion of the pump hose 124, as described previously herein.

Changes may be made in the embodiments of the invention described herein, or in parts or elements of the embodiments described herein, or in the sequence of steps of the methods described herein, without departing from the spirit and/or scope of the invention as defined in the following claims.

What is claimed is:

1. A utility belt for holding a painting device, comprising:

a belt, said belt having an upper surface, a lower surface, and an outer periphery, said belt having a closure element, said belt capable of extending around the waist of an operator;

a holder for holding a painting device, the holder comprising an upper holding means having first and second spaced portions, a side holding means, a lower holding means and a retaining and releasing means, said retaining and releasing means disposed on the lower holding means and being compressible, wherein the painting device comprises a handle having a lower handle section, a mid-handle section and an upper handle section, wherein the lower handle section of the painting device is set adjacent the lower holding means and against the retaining and releasing means thereby compressing the retaining and releasing means, wherein the mid-handle section of the painting device is pivotally moved adjacent and against the side holding means while the retaining and releasing means are compressed, and wherein the upper handle section is placed between the first and second portions of the upper holding means, and wherein the retaining and releasing means compress and hold both the upper handle section of the painting device against the upper holding means and the lower handle section adjacent the lower holding means when the retaining and releasing means are in an uncompressed position, thereby holding and maintaining the painting device in the holder; and connecting means for connecting the holder to the belt, wherein any significant tug on the holder causes a disconnection of the connecting means from the belt.

2. The utility belt of claim 1, wherein the belt further comprises a second holing device comprising a caulking gun holder for a caulking gun, said caulking gun holder comprising an upper holding means having first and second spaced portions, a side holding means, a lower holding means having an aperture therein and a retaining and releasing means, said retaining and releasing means disposed on the lower holding means and being compressible, wherein the caulking gun comprises a caulking container having a lower end and a nozzle, and a handle and an upper handle, the nozzle and the lower end of the caulking gun being disposed adjacent the lower holding means, the nozzle being inserted into the aperture and the lower end of the caulking gun being disposed adjacent the lower holding means, the lower end of the caulking gun compressing the retaining and releasing means, wherein the caulking container is pivotally moved adjacent and against the side holding means while the retaining and releasing means are compressed, and wherein the upper handle is positioned between the upper holding means, wherein the retaining and releasing means compress and hold both the upper handle of the caulking gun adjacent the upper holding means and the lower end of the caulking gun adjacent the lower holding means when the retaining and releasing means are in an uncompressed position, thereby holding and maintaining the caulking gun in the caulking gun holder.

3. The utility belt of claim 1, wherein the painting device comprises a spray gun.

4. The utility belt of claim 1, wherein the belt further comprises a pouch.

5. The utility belt of claim 1, wherein the connecting means further comprises a snap connector.

6. A method of using a utility belt for holding a painting device, comprising the steps of:

providing a belt, said belt comprising an upper surface, a lower surface, and an outer periphery, said belt having a closure element, a holder for holding a painting device, the holder comprising an upper holding means having first and second spaced portions, a side holding means, a lower holding means and a retaining and releasing means, said retaining and releasing means disposed on the lower holding means and being compressible; and connecting means for connecting the holder to the belt, wherein any significant tug on the holder causes a disconnection of the connecting means from the belt;

disposing the painting device in the holder, the painting device comprising a handle having a lower handle section, a mid-handle section and an upper handle section, the painting device disposed partially in the holder by inserting the lower handle section of the painting device adjacent the lower holding means and against the retaining and releasing means;

compressing the retaining and releasing means;

pivotally moving the mid-handle section adjacent and against the side holding means while the retaining and releasing means are compressed by the lower handle section, disposing the upper handle section between the first and second portions of the upper holding means; and releasing the compression of the retaining and releasing means such that the retaining and releasing means are in an uncompressed position, said retaining and releasing means compressing and holding both the upper handle section of the painting device against the upper holding means and the lower handle section adjacent the lower holding means when the retaining and releasing means are in the uncompressed position, thereby both holding and maintaining the painting device in the holder.

7. The method of claim 6, wherein in the step of providing a belt, the belt further comprises a second holding device comprising a caulking gun holder comprising an upper holding means having first and second spaced portions, a side holding means, a lower holding means having an aperture therein and a retaining and releasing means, said retaining and releasing means disposed on the lower holding means and being compressible, and including the steps of:

disposing the caulking gun into the holder, the caulking gun comprising a caulking container having a lower end and a nozzle, and a handle and an upper handle, the caulking gun disposed partially in the holder by inserting the nozzle into the aperture in the lower holding means of the holder, and the lower end of the caulking gun adjacent the lower holding means and against the retaining and releasing means;

compressing the retaining and releasing means;

pivotally moving the handle adjacent the side holding means while the retaining and releasing means are compressed by the lower handle, disposing the caulking container adjacent and against the side holding means;

positioning the upper handle section between the first and second portions of the upper holding means; and releasing the compression of the retaining and releasing means such that the retaining and releasing means are in the an uncompressed position, said retaining and releasing means thereby both holding and maintaining the caulking gun in the caulking gun holder.

8. The method of claim 6, wherein in the step of providing a belt, the painting device comprises a spray gun holder.

9. The method of claim 6, wherein in the step of providing a belt, the belt further comprises a pouch.

10. The method of claim 6, wherein in the step of providing a belt, the connecting means further comprises a snap connector.

* * * * *

UNITED STATES PATENT AND TRADEMARK OFFICE

CERTIFICATE OF CORRECTION

PATENT NO. : 5,609,283

DATED : March 11, 1997

INVENTOR(S) : William E. Harrison, Jr.

It is certified that error appears in the above-identified patent and that said Letters Patent is hereby corrected as shown below:

Cover Sheet, under '[56] References Cited, U.S. PATENT DOCUMENTS', please delete "5,500,786", and substitute therefor --5,050,786--.

Cover Sheet, under '[57] ABSTRACT', line 1, after 'having', please delete "a".

Column 2, line 42, please delete "opening", and substitute therefor --open--.

Column 3, line 6, after 'which', please delete "is".

Column 3, line 10, please delete "place", and substitute therefor --placed--.

Column 5, line 36, after 'spray gun handle', please delete "84", and substitute therefor --108--.

Column 7, line 4, after 'caulking gun holder', please delete "68", and substitute therefor --46--.

Signed and Sealed this

Seventeenth Day of June, 1997

Bruce Lehman

*Attest:*

BRUCE LEHMAN

*Attesting Officer*

*Commissioner of Patents and Trademarks*